US006349425B1

(12) United States Patent
Stradinger et al.

(10) Patent No.: US 6,349,425 B1
(45) Date of Patent: Feb. 26, 2002

(54) VALVE SET FOR A VACUUM TOILET

(75) Inventors: Jay D. Stradinger, Roscoe; William Bruce Anderson, Rockford; Mark A. Pondelick; Douglas M. Wallace, both of Roscoe; Michael B. Hancock, Rockford, all of IL (US); Arthur J. McGowan, Jr., Thornton, CO (US); Ian Tinkler, Rockford, IL (US)

(73) Assignee: Evac International Oy, Helsinki (FI)

( * ) Notice: Subject to any disclaimer, the term of this patent is extended or adjusted under 35 U.S.C. 154(b) by 0 days.

(21) Appl. No.: 09/713,870

(22) Filed: Nov. 16, 2000

(51) Int. Cl.[7] ..... E03D 11/00
(52) U.S. Cl. ..... 4/434; 4/431; 4/435; 137/588
(58) Field of Search ..... 4/300, 316, 431–435, 4/458; 137/588, 595, 553, 554, 192, 205

(56) References Cited

U.S. PATENT DOCUMENTS

| | | | | | |
|---|---|---|---|---|---|
| 3,239,849 | A | | 3/1966 | Liljendahl | 4/77 |
| 3,860,973 | A | * | 1/1975 | Uyeda et al. | 4/431 |
| 3,922,730 | A | | 12/1975 | Kemper | 4/10 |
| 3,995,328 | A | | 12/1976 | Carolan et al. | 4/10 |
| 4,063,315 | A | | 12/1977 | Carolan et al. | 4/10 |
| 4,184,506 | A | | 1/1980 | Varis et al. | 137/205 |
| 4,246,925 | A | | 1/1981 | Oldfelt | 137/205 |
| 4,275,470 | A | | 6/1981 | Badger et al. | 4/316 |
| 4,357,719 | A | | 11/1982 | Badger et al. | 4/316 |
| 4,438,781 | A | * | 3/1984 | Brenholt | 137/553 |
| 4,521,925 | A | | 6/1985 | Chen et al. | 4/362 |
| 4,713,847 | A | | 12/1987 | Oldfelt et al. | 4/316 |
| 5,007,117 | A | | 4/1991 | Oldfelt et al. | 4/432 |
| 5,099,867 | A | * | 3/1992 | Emery | 137/554 |
| 5,133,853 | A | | 7/1992 | Mattsson et al. | 210/104 |
| 5,271,105 | A | * | 12/1993 | Tyler | 4/431 |
| 5,604,938 | A | | 2/1997 | Tyler | 4/321 |
| 5,732,417 | A | | 3/1998 | Pondelick | 4/427 |
| 5,909,968 | A | * | 6/1999 | Olin et al. | 4/431 |
| 6,131,596 | A | | 10/2000 | Monson | 137/14 |
| 6,152,160 | A | | 11/2000 | Bowden Wilcox et al. | 137/15.01 |
| 6,186,162 | B1 | * | 2/2001 | Purvis et al. | 137/554 |
| 6,216,285 | B1 | | 4/2001 | Olin | 4/431 |

* cited by examiner

*Primary Examiner*—Gregory L. Huson
*Assistant Examiner*—Tuan Nguyen
(74) *Attorney, Agent, or Firm*—Marshall, Gerstein, & Borun

(57) ABSTRACT

An integrated valve set for use in a vacuum toilet system is disclosed. The vacuum toilet system includes a waste receptacle defining an outlet and having a rinse fluid nozzle, a source of rinse fluid, and a sewer line placeable under partial vacuum pressure. The integrated valve set comprises a discharge valve having an inlet in fluid communication with the waste receptacle outlet, an outlet in fluid communication with the sewer line, and a rotatable discharge valve member adapted to selectively establish fluid communication between the discharge valve inlet and discharge valve outlet. An integrally mounted rinse fluid valve has an inlet in fluid communication with the pressurized rinse fluid source, an outlet in fluid communication with the rinse fluid nozzle, and a rinse fluid valve member adapted to selectively establish fluid communication between the rinse fluid valve inlet and the rinse fluid valve outlet. An integrally mounted actuator is adapted to rotate the discharge valve member and the rinse fluid valve member. An integrally mounted flush control unit has a circuit board operably connected to the actuator to selectively drive the actuator.

16 Claims, 7 Drawing Sheets

72
104
105
112
114
110
111
115
113
132
137
138
130
133
100
135
137
136
134
131
120
121
140
123
103
126
126
124
127
101
106
102
142
141
125
126
117
122
107
118

VALVE SET FOR A VACUUM TOILET

FIELD OF THE INVENTION

The present invention generally relates to toilets and, more particularly, to vacuum toilet systems.

BACKGROUND OF THE INVENTION

Vacuum toilet systems are generally known in the art for use in both vehicle and stationary applications. A vacuum toilet system typically comprises a bowl for receiving waste having an outlet connected to a vacuum sewer line. A discharge valve is disposed between the bowl outlet and vacuum sewer line to selectively establish fluid communication therebetween. The vacuum sewer line is connected to a collection tank that is placed under partial vacuum pressure by a vacuum source, such as a vacuum blower. When the discharge valve is opened, material in the bowl is transported to the sewer pipe as a result of the pressure difference between the interior of the bowl and the interior of the sewer line. Conventional vacuum toilet systems also include a source of rinse fluid and a rinse fluid valve for controlling introduction of rinse fluid into the bowl.

The components of a conventional vacuum toilet are typically provided separately and are overly difficult to assemble. The discharge valve is typically mounted in a first position, while the rinse valve is mounted in a second, separate position. A flush control unit (FCU) is mounted remote from both valves and provides control signals to the discharge and rinse valve actuators. Accordingly, various mounting brackets, tubing, and wires are needed to interconnect the various components, making assembly overly complicated and time-consuming.

In addition, the separate components used in conventional vacuum toilets make repair and maintenance overly time consuming and labor intensive. Maintenance concerns are particularly significant in aircraft applications, in which a number of subsystems are installed on board. According to general practice in the airline industry, each sub-system includes one or more components which must be replaced in the event of failure, such replacement components being commonly referred to as line replaceable units (LRUs). Presently, the entire toilet assembly is defined as the LRU for the vacuum toilet system. As a result, an airline must stock one or more replacement toilets in the event of a toilet failure, so that the replacement toilet may be swapped in for the faulty toilet. A "bench test" is then performed on the faulty toilet to determine which components have failed in the toilet. The faulty components are then repaired or replaced (which may include significant disassembly and reassembly of the toilet) so that the toilet may be reused on another aircraft.

Each of the steps performed during a toilet repair is overly difficult and time consuming. To remove an entire toilet assembly from an aircraft requires disassembly of at least four self-locking mounting fasteners, an electrical connection, a grounding strap, a potable water line connection, and a waste discharge pipe connection. Each connection may be difficult to access, and may require a particular tool in order to loosen and disconnect. The same connections must then be reconnected for the replacement toilet.

Even if it were possible to remove and replace a single toilet component, it would be overly difficult and time consuming to do so. Removal of a component would require disconnection of several wires and pipes, and the components are often located in areas which are difficult to access.

Furthermore, it would be difficult to diagnose whether one component or several components had failed. There exists a multitude of combinations of simultaneous component failures, which may lead to trouble-shooting errors and the replacement or repair of non-faulty components.

Conventional vacuum toilets further fail to provide adequate feedback regarding valve position. Conventional discharge valves are typically driven by an electric motor actuator having mechanical limit switches and signal switches to control valve position. Such a switch is overly complicated to use and maintain. The switches must be precisely set to trigger at the appropriate time, and special tooling is often required to set the switch. In addition, by locating the switches in the actuator, they are subject to mechanical wear and contact erosion, which may alter the setting of the switch, thereby requiring re-setting. Furthermore, lubricant or other materials may migrate to the switches, causing switch failure. Most importantly, the conventional apparatus is unreliable since valve position is inferred from the actuator position. As a result, the conventional approach is not responsive to various failure situations where the actuator may be operable but the valve is not, such as when the linkage connecting the actuator to the valve is broken or defective.

SUMMARY OF THE INVENTION

In accordance with certain aspects of the present invention, an integrated valve set is provided for use in a vacuum toilet system including a waste receptacle defining an outlet, the waste receptacle having a rinse fluid dispenser associated therewith, a source of rinse fluid, and a sewer line placeable under partial vacuum. The integrated valve set comprises a discharge valve having an inlet in fluid communication with the waste receptacle outlet, an outlet in fluid communication with the sewer line, and a movable discharge valve member adapted to selectively establish fluid communication between the discharge valve inlet and discharge valve outlet. A rinse fluid valve has an inlet in fluid communication with the rinse fluid source, an outlet in fluid communication with the rinse fluid dispenser, and a rinse fluid valve member adapted to selectively establish fluid communication between the rinse fluid valve inlet and rinse fluid valve outlet, the rinse fluid valve member being coupled for rotation with the discharge valve member. The rinse fluid valve member is coupled for movement with the discharge valve member.

In accordance with additional aspects of the present invention, an integrated valve set is provided for use in a vacuum toilet system having a waste receptacle defining an outlet and a sewer line placeable under partial vacuum. The integrated valve set comprises a discharge valve having a housing with an inlet in fluid communication with the waste receptacle outlet and an outlet in fluid communication with the sewer line, and a movable discharge valve member disposed in the housing and adapted to selectively establish fluid communication between the discharge valve housing inlet and the discharge valve housing outlet. A flush control unit is operably connected to the discharge valve and has a housing attached to the discharge valve housing, the flush control unit including a position sensor for detecting the position of the discharge valve member.

In accordance with further aspects of the present invention, an integrated valve set is provided for use in a vacuum toilet system having a waste receptacle defining an outlet and having a rinse fluid dispenser associated therewith, a source of rinse fluid, and a sewer line placeable under partial vacuum pressure. The integrated valve set comprises a discharge valve having an inlet in fluid communication with the waste receptacle outlet, an outlet in fluid communication with the sewer line, and a movable discharge valve member adapted to selectively establish fluid communication between the discharge valve inlet and discharge valve outlet. An integrally mounted rinse fluid valve has an inlet in fluid communication with the rinse fluid source, an outlet in fluid communication with the rinse fluid dispenser, and a rinse fluid valve member adapted to selectively establish fluid communication between the rinse fluid valve inlet and the rinse fluid valve outlet.

In accordance with still further aspects of the present invention, a

Other features and advantages are inherent in the apparatus claimed and disclosed or will become apparent to those skilled in the art from the following detailed description and its accompanying drawings.

DETAILED DESCRIPTION OF THE PREFERRED EMBODIMENTS

Figure 1A:
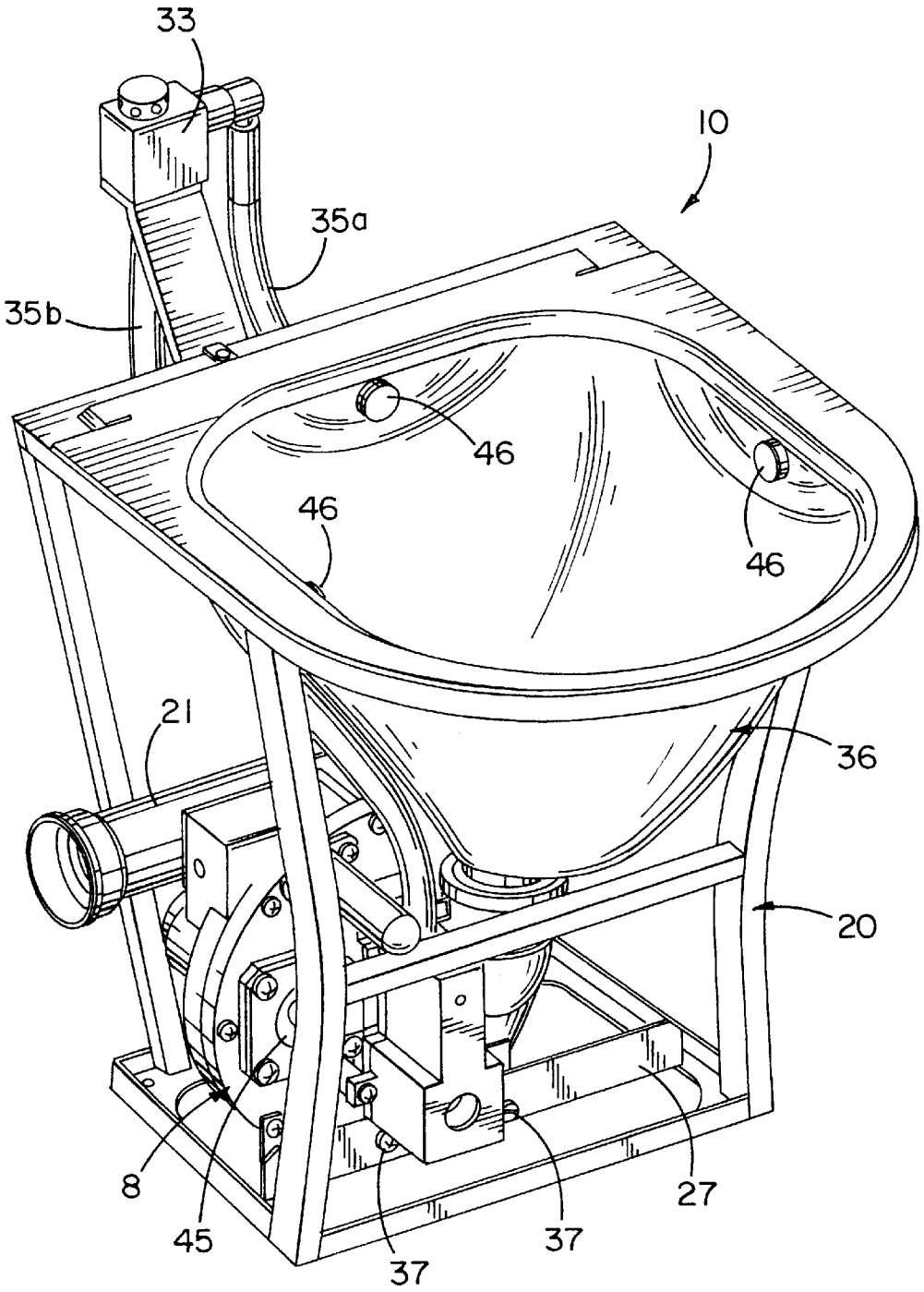
FIGS. 1A and 1B are perspective views of a vacuum toilet incorporating a valve set in accordance with the present invention.
Figure 1B:
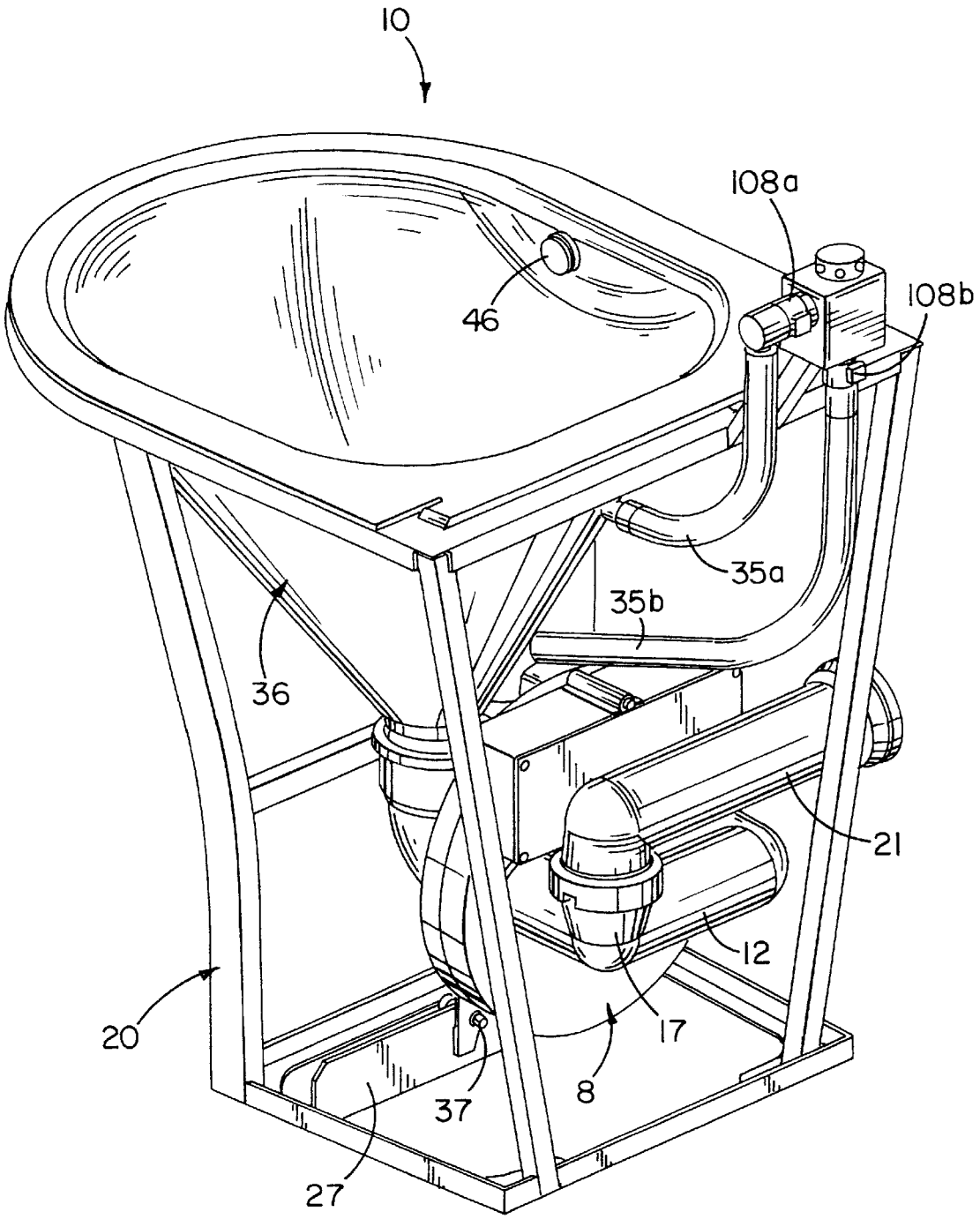
Figure 2:
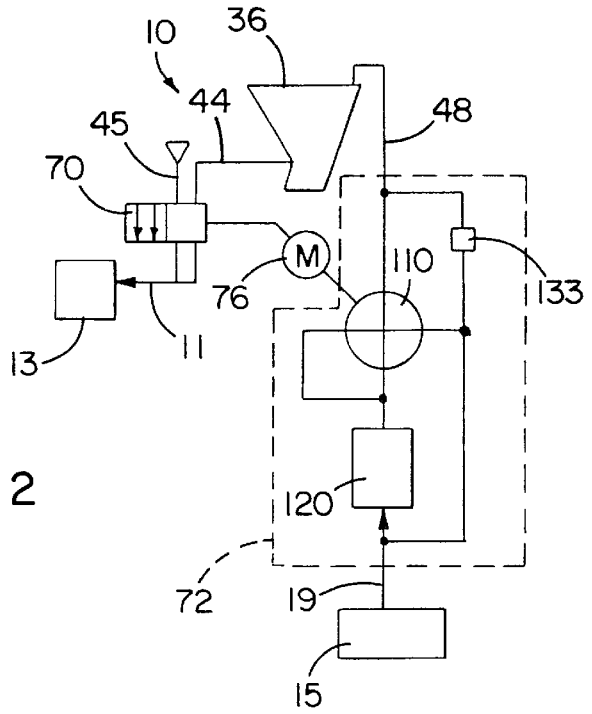
FIG. 2 is a schematic diagram of the vacuum toilet of FIG. 1.

A vacuum toilet 10 suitable for use in a vehicle is illustrated in FIGS. 1A, 1B and 2 having a valve set 8 in accordance with the present invention. The vehicle is provided with a sewer line 11, a vacuum tank 13 connected to the sewer line 11, and a vacuum source (not shown) for placing the vacuum tank 13 under partial vacuum pressure. The vehicle further includes a source of rinse fluid 15 connected to a rinse fluid supply line 19.

The vacuum toilet 10 includes a bowl 36 for receiving waste material connected to the valve set 8. In the preferred embodiment, the bowl 36 is supported by a frame 20 to form a replaceable bowl assembly, as described in greater detail in commonly owned and co-pending U.S. patent application Ser. No. 09/713,861, entitled "Toilet Bowl Assembly", incorporated herein by reference. The frame 20 preferably includes a bracket 27 adapted to support the valve set 8. The valve set 8 may be attached to the bracket 27 using fasteners that may be manipulated by hand, such as knurled screws 37. At least one rinse fluid dispenser, such as nozzles 46, is provided inside the bowl 36 for directing rinse fluid over the surface of the bowl. A first rinse fluid pipe 35*a* connects the nozzles 46 to a vacuum breaker 33. A second rinse fluid pipe 35*b* extends from the vacuum breaker 33 to the valve set 8. Quick-disconnect couplings 108*a*, 108*b* are provided to connect the first and second rinse fluid pipes 35*a*, 35*b* to the vacuum breaker 33.

Figure 3:
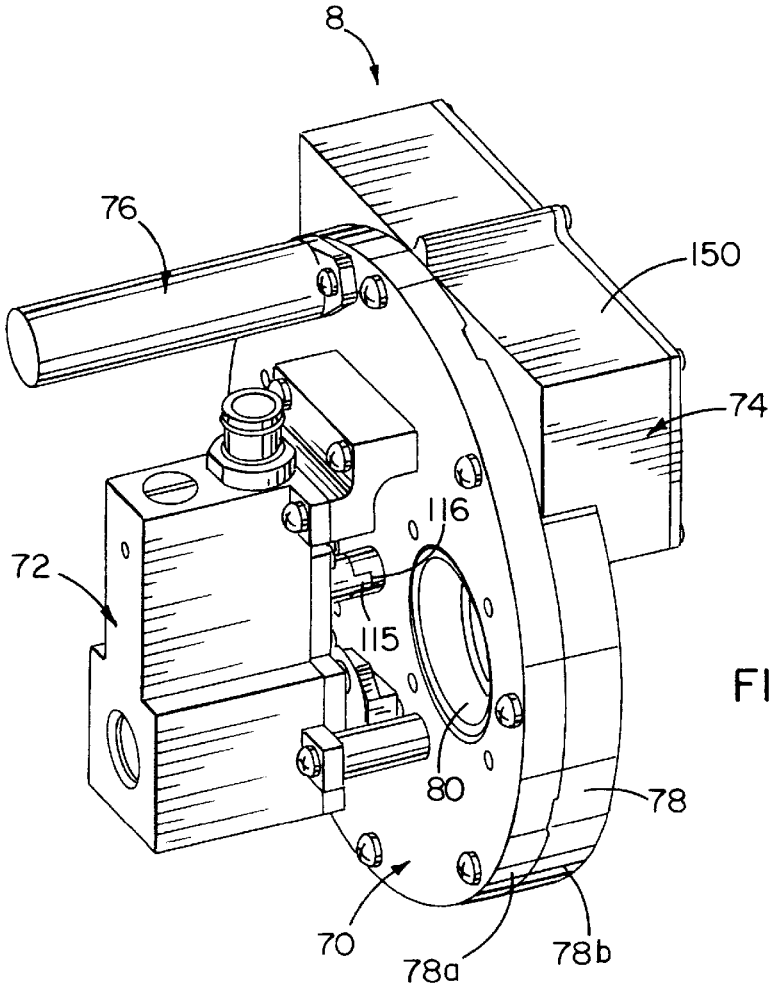
FIG. 3 is an enlarged perspective view of the valve set incorporated into the vacuum toilet of FIG. 1.
Figure 4A:
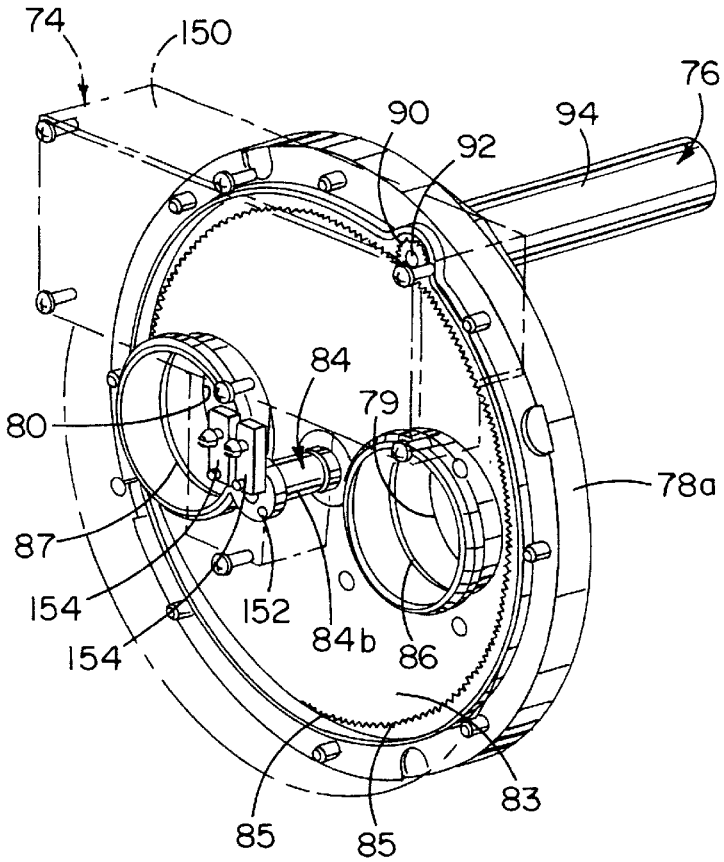
FIGS. 4A and 4B are perspective views of a discharge valve and actuator incorporated into the valve set.
Figure 4B:
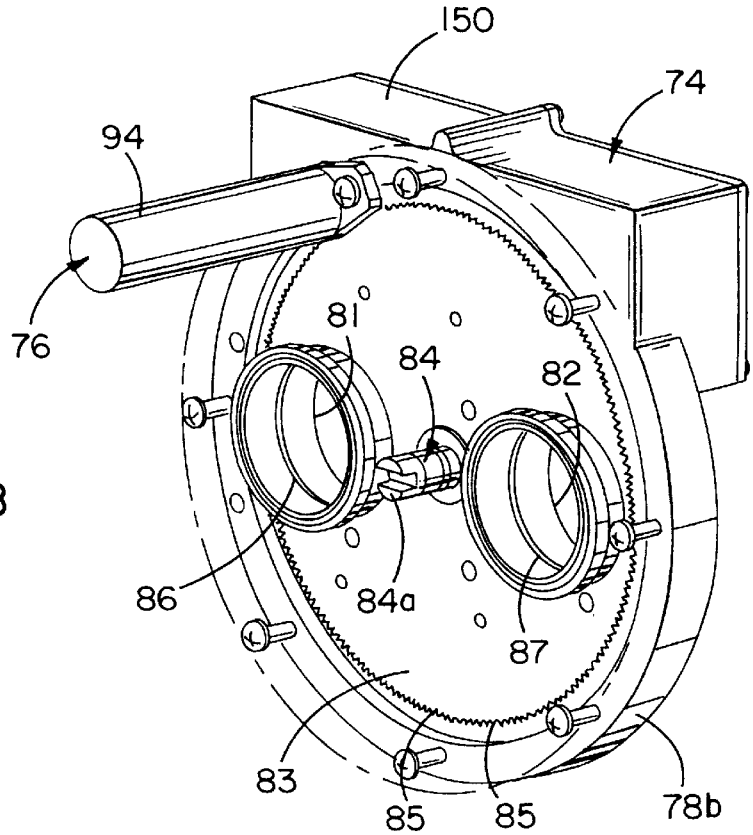

As shown in FIG. 3, the valve set 8 comprises four sub-components: a discharge valve 70, a rinse valve 72, a flush control unit (FCU) 74, and an actuator 76. The discharge valve 70 includes a discharge valve housing 78 divided into two halves 78*a*, 78*b*. As best shown in FIGS. 4A and 4B, the housing 78 includes a pair of inlets 79, 80 formed in the housing half 78*a* aligned with a pair of outlets 81, 82 formed in the housing half 78*b*.

The housing 78 further defines a chamber for receiving a discharge valve member, such as valve disk 83. An axle 84 is attached to the valve disk 80 and has two ends 84*a*, 84*b*. Holes are formed in the housing halves 78*a*, 78*b* sized to receive the axle ends 84*a*, 84*b*, respectively, so that the disk 83 is supported for rotation about the axle 84. The periphery of the disk 83 is formed with gear teeth 85, and a pair of apertures 86, 87 are formed through the disk 83. The apertures 86, 87 are spaced so that both register simultaneously with the associated inlet/outlet pairs 79/81, 80/82 as the disk 83 rotates. In the illustrated embodiment, the apertures 85,86 and associated inlet/outlet pairs 79/81, 80/82 are spaced 180 degrees apart.

According to the illustrated embodiment, the inlet 79 is connected to one end of a transfer pipe 44, with the other end of the transfer pipe 44 being attached to an outlet 42 of the bowl 36. In the preferred embodiment, the transfer pipe 44 includes a fitting 47 (FIG. 1A) adapted to frictionally and sealingly engage the bowl outlet 42, so that the transfer pipe 44 may be quickly and easily attached and removed from the bowl outlet 42. An air intake check valve 45 is attached to the other inlet 80, and is oriented to allow fluid to flow into the inlet 80 while preventing fluid from discharging out of the check valve 45 (FIGS. 1A and 2). A U-shaped outlet pipe 12 (FIG. 1B) has a first end connected to the outlet 81 and a second end connected to the outlet 82. The outlet pipe 12 further has a branch 17 leading to a discharge pipe 21. In the preferred embodiment, the branch 17 includes a pair of spaced pins and the discharge pipe 21 includes a pair of J-shaped slots positioned to engage the pins, so that the discharge pipe 21 is removably attached to the branch 17. Furthermore, when the pins and J-shaped slots are spaced 180 degrees apart, the discharge pipe 21 may be positioned for either right- or left-handed discharge simply by rotating the discharge pipe before attachment, without requiring changes to the other toilet components. The free end of the discharge pipe 21 is adapted for releasable connection to the sewer line 11, such as with a clam shell coupling (not shown).

In operation, when the disk apertures 86, 87 are aligned with the inlet/outlet pairs 79/81, 80/82, the discharge valve 70 not only transfers waste from the drain pipe 44 to the sewer line 11, but also pulls additional air into the sewer line 11 through the air intake check valve 45. The additional air intake reduces noise that is normally generated during a flush.

The actuator 76 is provided for driving the valve disk 83. As best shown in FIG. 4A, the actuator 76 includes a spur gear 90 enmeshed with the gear teeth 85 formed about the periphery of the disk 83. The spur gear 90 is mounted to a rotatable shaft 92, and a drive is provided for rotating the shaft 92. The FCU 74 is operably coupled to the actuator 76 to control operation of the actuator. According to the illustrated embodiment, the disk 83 may be rotated in a single direction by ninety degree increments to open and close the discharge valve 70. Alternatively, the disk 83 may also be reciprocated back and forth across a ninety degree arc to open and close the valve 70, or the disk 83 may be controlled in other manners according to other disk designs and layouts.

Figure 5:
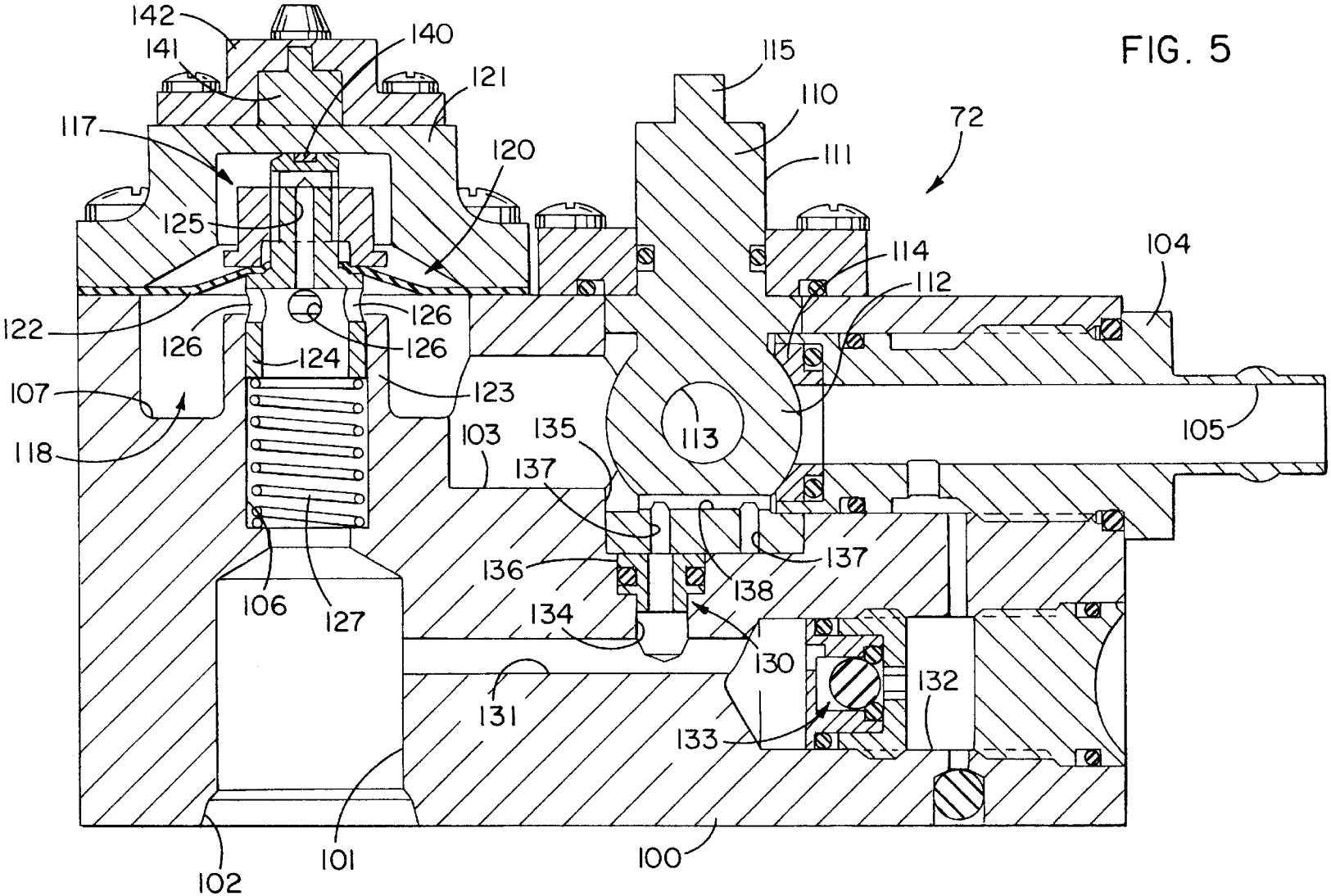
FIG. 5 is a side elevation view, in cross-section, of a rinse valve assembly incorporated into the valve set.

The rinse valve 72 is provided for controlling flow of rinse fluid to the bowl 36. As best shown in FIG. 5, the rinse valve 72 comprises a housing block 100 formed with an inlet bore 101 defining an inlet 102 and an outlet bore 103. The inlet bore 103 is adapted for connection to the rinse fluid line 19 via quick-disconnect coupling (not shown). An insert 104 is positioned in a downstream portion of the outlet bore 103 and defines an outlet 105. The outlet end of the insert 104 is barbed to secure one end of a rinse fluid pipe 35*b* thereto, while the opposite end of the second rinse fluid pipe 35*b* has the quick-disconnect coupling 108*b* (FIGS. 1A and 1B). A poppet valve bore 106 is also formed in the housing block 100, and fluidly communicates with the inlet bore 101. An annular recess 107 is formed in the housing block 100 concentric with the poppet valve bore 106 to establish fluid communication between the poppet valve bore 106 and the outlet bore 103.

The rinse valve 72 includes a rinse valve member, such as a ball valve 110, which is disposed in the outlet bore 103 for selectively establishing fluid communication between the outlet bore 103 and the outlet 105. The ball valve 110 includes a shaft 111 and a valve member 112 having a flow passage 113 extending therethrough. A seal 114 is provided downstream of the valve member 112 for preventing leakage between the valve member 112 and the downstream portion of the outlet bore 103. As shown in FIG. 5, the flow passage 113 is perpendicular to the outlet bore 103, thereby preventing fluid flow. The ball valve 110 is rotatable, however, to align the flow passage 113 with the outlet bore 103, thereby establishing fluid communication between the upstream portion of the outlet bore 103 and outlet 105.

In accordance with certain aspects of the present invention, the top of the shaft 111 is adapted to mechanically engage the axle end 84*a*, as best shown in FIG. 3, so that rotation of the disk 83 also rotates the ball valve 110. In the illustrated embodiment, the shaft 111 is formed with a key 115, while the axle end 84*a* has a slot 116 sized to receive the key 115. As a result, a separate actuator is not required to actuate the ball valve 110, thereby reducing cost and space requirements for the toilet.

The rinse valve 72 further includes a fuse valve 120 for metering rinse fluid flow through the rinse valve when the ball valve 110 is open. As used herein, the phrase "fuse valve" indicates a valve that actuates after a set value of fluid has passed therethrough. As best shown in FIG. 5, a bonnet 121 is attached to the housing block 100 to close off the poppet valve bore 106 and the recess 107. A flexible diaphragm 122 is attached between the housing block 100 and the bonnet 121 to define a pilot chamber 117 above the diaphragm 122 and a flow chamber 118 below the diaphragm 122. As shown in FIG. 5, the diaphragm 122 is in a closed position, in which the diaphragm 122 engages an annular intermediate wall 123 extending between the poppet valve bore 106 and recess 107, thereby closing off fluid communication between the poppet valve bore 106 and recess 107. A poppet valve 124 is disposed inside the poppet valve bore 106 and is attached to the diaphragm 122, so that the poppet valve 124 moves with the diaphragm 122. The top of the poppet valve 124 is formed with a pilot port 125, and flow ports 126 extend radially through a sidewall of the poppet valve 124. A spring 127 is disposed in the poppet valve port for biasing the diaphragm 122 away from the intermediate wall 123 toward an open position, in which fluid communication is established between the poppet valve bore 106 and the recess 107.

Figure 6A:
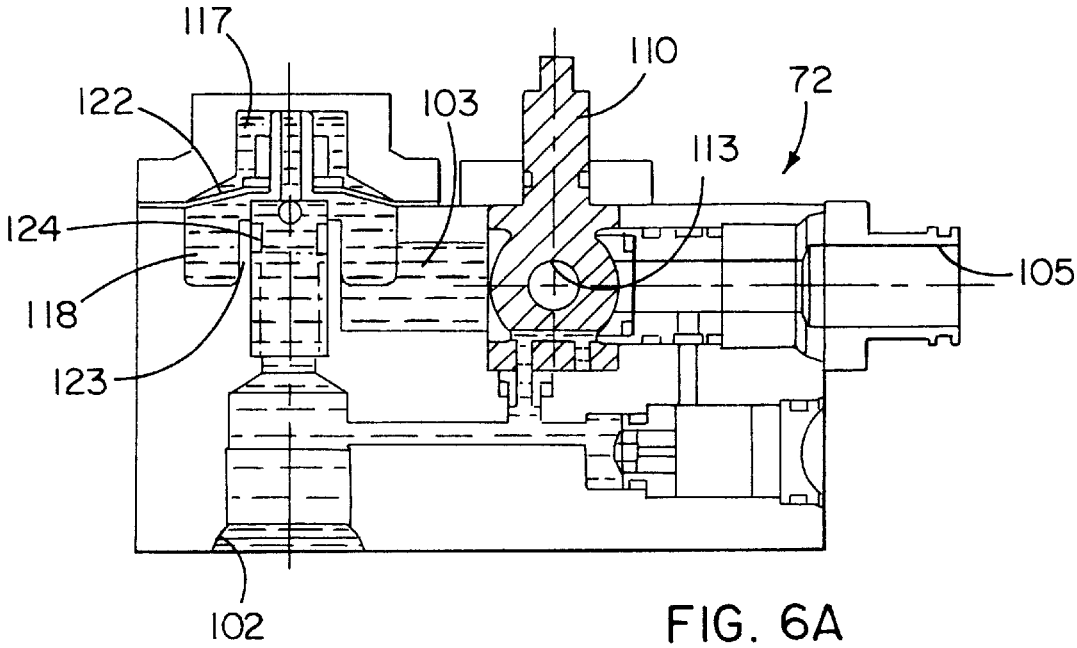
FIGS. 6A–D are side elevation views, in cross-section, of the rinse valve assembly showing the various stages of a rinse cycle.

The fuse valve 120 limits the amount of rinse fluid allowed to flow through the rinse valve 72 when the ball valve 110 is open. During operation, the ball valve 110 is normally in a closed position to prevent flow of rinse fluid through the rinse valve 72. The rinse fluid flows through both the pilot port 125 to register at the pilot chamber 117, and through the flow ports 126 to register in the flow chamber 118. Because there is no rinse fluid flow, the rinse fluid pressure is the same in both the pilot chamber 117 and the flow chamber 118, so that the spring 127 urges the diaphragm 122 and poppet valve 124 to the open position, as shown in FIG. 6A.

Figure 6C:
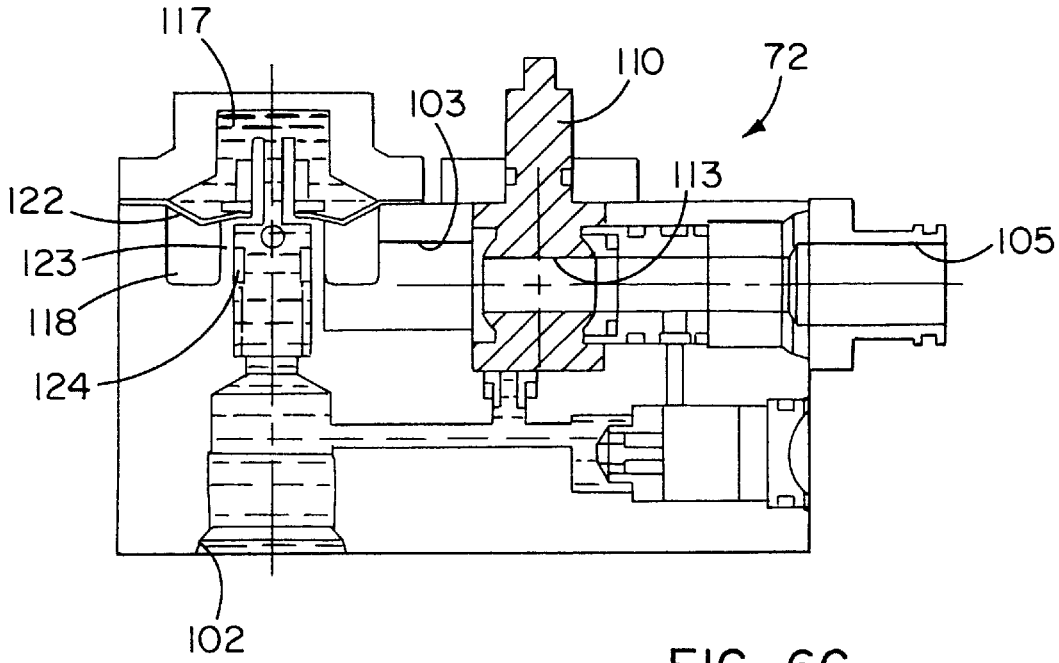
Figure 6B:
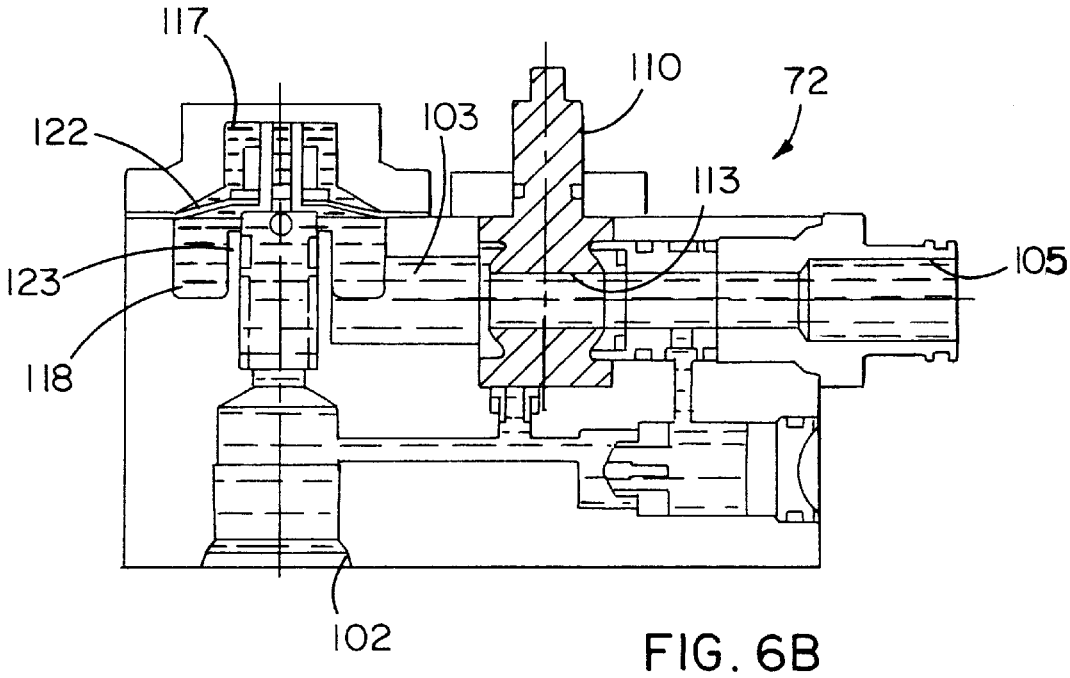

In response to a flush command, the ball valve 110 is rotated to the open position so that the ball valve flow passage 113 communicates the outlet bore 103 to the outlet 105, thereby creating fluid flow through the valve 72 (FIG. 6B). During fluid flow, the rinse fluid experiences a pressure drop as it passes through the flow ports 126, thereby reducing the fluid pressure in the flow chamber 118 while the pressure in the pilot chamber 117 stays substantially the same. The resulting pressure differential across the diaphragm 122 ultimately overcomes the force of the spring 127 so that the diaphragm 122 and poppet valve 124 move to the closed position, as shown in FIG. 6C. When the diaphragm is in the closed position, fluid flow through the rinse valve 72 is again cut off, this time by the engagement of the diaphragm 122 with the intermediate wall 123. Because of the fuse valve 120, the volume of rinse fluid passing through the open ball valve 110 is substantially constant from flush to flush, regardless of the rinse fluid pressure supplied to the rinse valve 72. It will also be appreciated that the fuse valve 120 provides a redundant shut-off, so that the ball valve 110 or the fuse valve 120 may be used to stop rinse fluid flow should the other fail.

The rinse valve 72 further includes a face valve 130 for returning the diaphragm 121 back to the open position after the ball valve 110 is subsequently closed. Referring to FIG. 5, a bypass bore 131 is formed in the housing block 100 that connects the inlet bore 101 to an auxiliary bore 132. A reset bore 134 intersects the bypass bore 131 and communicates with a ball valve bore 135 formed in the housing block 100. A reset insert 136 is inserted in the reset bore 134 and has a top surface adapted to engage a bottom of the ball valve 110. The ball valve 110 is formed with reset passages 137 extending into the ball valve 110 to a transverse passage 138 extending entirely through the ball valve 110. The reset passages 137 are located on the ball valve 110 so that they align with the reset insert 136 only when the ball valve 110 is in the closed position. The seal 114 prevents rinse fluid from leaking from the transverse passage 138 to the outlet 105. No seal is provided upstream of the ball valve 110 so that, when one of the reset passages 137 is aligned with the insert 136, fluid communication is established from the inlet bore 101, through the bypass and reset bores 131, 134 and one of the reset passages 137 to the flow chamber 118.

According to the illustrated embodiment, the rinse valve 72 also includes a drain valve 133 disposed in the auxiliary bore 132 to provide freeze protection, as is well known in the art.

Figure 6D:
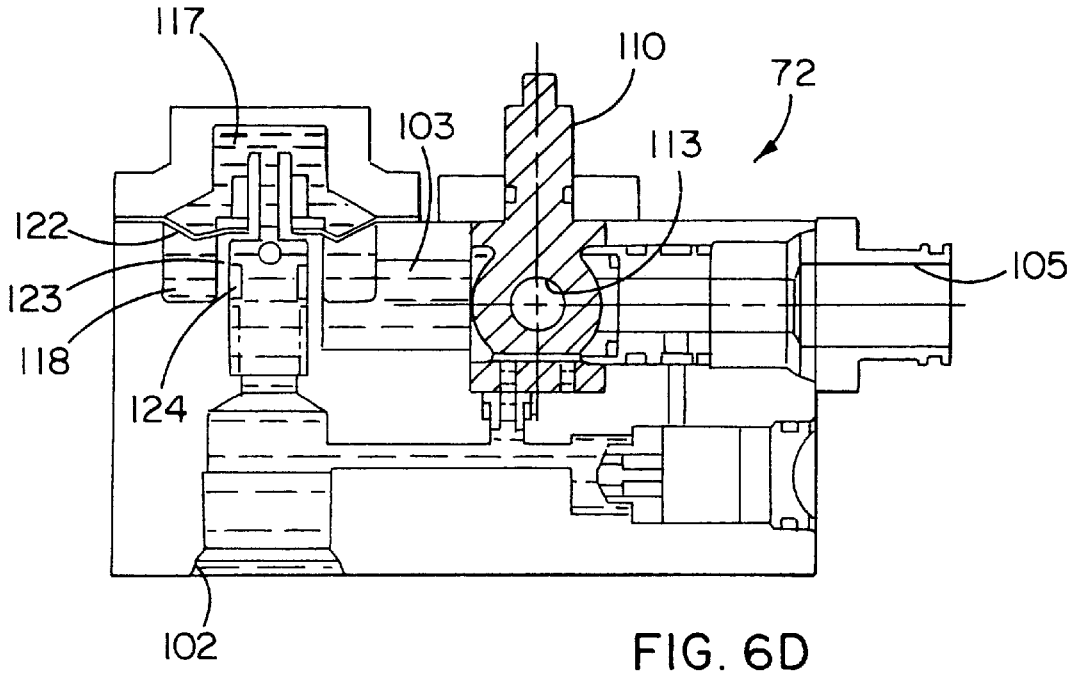

In operation, the diaphragm 121 moves to the closed position while the ball valve 10 is open, thereby stopping rinse fluid flow through the rinse valve 72 (FIG. 6C). With the ball valve 110 in the open position, neither reset passage 137 is aligned with the reset insert 136. The ball valve 110 is subsequently closed, thereby aligning one of the reset passages 137 with the insert 136 and establishing fluid communication from the inlet bore 101 to the flow chamber 118 (FIG. 6D). The incoming rinse fluid pressure registers at the flow chamber 118, so that the flow chamber reaches the same pressure as the pilot chamber 117. With the differential pressure across the diaphragm 121 removed, the spring 127 is again allowed to urge the diaphragm 121 to the open position, thereby resetting the fuse valve 120 to the position shown in FIG. 6A.

In the preferred embodiment, a position sensor is used to provide feedback regarding poppet valve position feedback. In the illustrated embodiment, a magnet 140 is attached to the poppet valve 124, and a hall effect switch 141 is located outside of the bonnet 121 in a switch enclosure 142 attached to the bonnet 121 (FIG. 5). The hall effect switch 141 provides a signal that varies according to the position of the magnet 140 to indicate the position of the poppet valve 124. The poppet valve position signal may be used for diagnostic purposes such as fault detection by comparing the position signal to the position of the disk 83 or ball valve 110.

The FCU 74 comprises a housing 150 attached to the discharge valve housing half 78*b* opposite the rinse valve 72 (FIG. 3). The housing 150 encloses one or more circuit boards 155 (not shown) for controlling operation of the discharge valve 70 via the actuator 76. Because the FCU 74 is located proximal to the actuator 76, the number of wires needed between the FCU 74 and actuator 76 is reduced. In addition to the typical inputs and outputs, the FCU 74 also receives feedback from the poppet valve position sensor 141.

The FCU housing 150 further houses a position sensor for determining the position of the disk 83. As best shown in FIG. 4A, magnets 152 are attached to the axle end 84*b* of the disk 83. The axle end 84*b* extends into the FCU housing 150, so that the magnets 152 are positioned proximal the control board. Hall effect switches 154 are provided directly on the circuit board for sensing the magnets 152 and thus determining the rotational position of the disk 83. In the illustrated embodiment, a pair of magnets 152 are attached to the axle end 84*b*, and a pair of hall effect switches 154 are attached to the circuit board. The switches 154 actuate between on and off positions depending on the proximity of the magnets, thereby indicating the position of the disk 83. As a result, the position of the disk 83 is directly sensed rather than inferring disk position based on actuator position. Because the switches 154 are provided directly on the circuit board, wiring from the FCU 74 to the switches is not required. Furthermore, the use of hall effect switches 154 located inside the FCU housing 150 prevents mechanical wear, contact erosion, and contamination due to lubrication or other material associated with the discharge valve 70.

From the foregoing, it will be appreciated that the valve set 8 of the present invention decreases downtime needed to fix a faulty toilet. The rinse valve 72, FCU 74, and actuator 76 are all mounted to the discharge valve 70, so that a single module is removed and replaced in the event of a valve or control failure. To remove the valve set 8, the discharge pipe 21 is disconnected from the sewer line 11, the rinse valve inlet 102 is disconnected from the rinse supply line 19, and the quick-disconnect coupling 108*b* of the second rinse fluid pipe 35*b* is disconnected from the vacuum breaker 33. The knurled screws 37 are then removed from the bracket 27 and the valve set 8 with attached transfer pipe 44 is lowered so that the transfer pipe disengages the bowl outlet 42. Thus the valve set 8 is removed with the transfer pipe 44, outlet pipe 12, discharge pipe 21, and second rinse pipe 35*b*. A new valve set 8, also having a new transfer pipe 44, outlet pipe 12, discharge pipe 21, and second rinse pipe 35*b* may then be attached to the bracket 27 and reconnected. As a result, the valve set 9 is much easier to remove than the entire toilet 10, as is required with conventional toilets. Furthermore, the valve set 8 is smaller and therefore more easily shipped for service, thereby reducing damage during handling.

The foregoing detailed description has be given for clearness of understanding only, and no unnecessary limitations should be understood therefrom, as modifications would be obvious to those skilled in the art.

What is claimed is:

1. An integrated valve set for use in a vacuum toilet system having a waste receptacle defining an outlet and having a rinse fluid dispenser associated therewith, a source of rinse fluid, and a sewer line placeable under partial vacuum, the integrated valve set comprising:

a discharge valve having an inlet in fluid communication with the waste receptacle outlet, an outlet in fluid communication with the sewer line, and a movable discharge valve member comprises a rotatable disk having a coupling member and adapted to selectively establish fluid communication between the discharge valve inlet and discharge valve outlet; and a rinse fluid valve having an inlet in fluid communication with the rinse fluid source, an outlet in fluid communication with the rinse fluid dispenser, and a rinse fluid valve member adapted to selectively establish fluid communication between the rinse fluid valve inlet and rinse fluid valve outlet, the rinse fluid valve member being coupled to the coupling member for rotation with the discharge valve member.

2. The integrated valve set of claim 1, in which the rinse fluid valve member comprises a ball valve.

3. The integrated valve set of claim 2, in which the coupling member is an axle and the ball valve comprises a shaft, and in which the axle is mechanically coupled to the shaft.

4. The integrated valve set of claim 2, further comprising a flush control unit operably connected to the discharge valve and the rinse fluid valve.

5. The integrated valve set of claim 4, further comprising an actuator adapted to engage the discharge valve member operably connected to the flush control unit, wherein rotation of the actuator rotates the discharge valve member and rinse fluid valve member.

6. The integrated valve set of claim 5, in which a series of gear teeth are formed about a periphery of the disk, and in which the actuator comprises a rotatable spur gear positioned to engage the periphery of the disk.

7. The integrated valve set of claim 1, further comprising a position sensor for detecting the position of the discharge valve member.

8. The integrated valve set of claim 7, in which the discharge valve member comprises a magnet, and in which the position sensor comprises a hall effect switch responsive to the magnet.

9. An integrated valve set for use in a vacuum toilet system having a waste receptacle defining an outlet and having a rinse fluid dispenser associated therewith, a source of rinse fluid, and a sewer line placeable under partial vacuum pressure, the integrated valve set comprising:

a discharge valve having an inlet in fluid communication with the waste receptacle outlet, an outlet in fluid communication with the sewer line, and a movable discharge valve member comprises a rotatable disk having a coupling member and adapted to selectively establish fluid communication between the discharge valve inlet and discharge valve outlet;

an integrally mounted rinse fluid valve having an inlet in fluid communication with the rinse fluid source, an outlet in fluid communication with the rinse fluid dispenser, and a rinse fluid valve member adapted to selectively establish fluid communication between the rinse fluid valve inlet and the rinse fluid valve outlet the rinse fluid valve member being integrally coupled to the coupling member for rotation with the discharge valve member.

10. The integrated valve set of claim 9, in which releasable couplings are provided between the discharge valve inlet and the waste receptacle outlet, the discharge valve outlet and the sewer line, the rinse fluid valve inlet and the rinse fluid source, and the rinse fluid valve outlet and the rinse fluid dispenser.

11. The integrated valve set of claim 9, further comprising an integrally mounted actuator adapted to rotate the discharge valve member.

12. The integrated valve set of claim 9, in which the discharge valve member comprises a rotatable disk having a series of gear teeth formed about a periphery of the disk, and in which the actuator comprises a rotatable spur gear positioned to engage a periphery of the disk.

13. The integrated valve set of claim 9, further comprising an integrally mounted flush control unit having a circuit board operably connected to the actuator to selectively drive the actuator.

14. The integrated valve set of claim 13, in which the flush control unit further comprises a position sensor for detecting a position of the discharge valve member.

15. The integrated valve set of claim 14, in which a magnet is attached to the discharge valve member, and in which the position sensor comprises a hall effect switch responsive to a position of the magnet.

16. The integrated valve set of claim 15, in which the coupling member is an axle with an end disposed inside the flush control unit proximate the circuit board, the magnet is attached to the axle end, and the hall effect switch is provided on the circuit board.

* * * * *